US008517485B2

(12) United States Patent
Heylen et al.

(10) Patent No.: US 8,517,485 B2
(45) Date of Patent: Aug. 27, 2013

(54) INKJET PRINTER AND FLOW RESTRICTION SYSTEM THEREFOR

(75) Inventors: Henry Charles Heylen, Colne (GB); Robert Lionel Walton, Wellingborough (GB)

(73) Assignee: Linx Printing Technologies Ltd., Cambridgeshire (GB)

( * ) Notice: Subject to any disclaimer, the term of this patent is extended or adjusted under 35 U.S.C. 154(b) by 331 days.

(21) Appl. No.: 12/747,164

(22) PCT Filed: Dec. 18, 2008

(86) PCT No.: PCT/GB2008/004181

§ 371 (c)(1),
(2), (4) Date: Jun. 9, 2010

(87) PCT Pub. No.: WO2009/081110

PCT Pub. Date: Jul. 2, 2009

(65) Prior Publication Data

US 2011/0001771 A1 Jan. 6, 2011

(30) Foreign Application Priority Data

Dec. 21, 2007 (GB) ..... 0724961.8

(51) Int. Cl.

| | |
|---|---|
| ***B41J 29/38*** | (2006.01) |
| *B41J 2/17* | (2006.01) |
| *B41J 2/175* | (2006.01) |
| *B41J 2/185* | (2006.01) |
| *B41J 2/19* | (2006.01) |

(52) U.S. Cl.
USPC ..... 347/6; 347/84; 347/85; 347/90; 347/92

(58) Field of Classification Search
USPC ..... 347/6, 84, 85, 90, 92
See application file for complete search history.

(56) References Cited

U.S. PATENT DOCUMENTS

| | | | |
|---|---|---|---|
| 4,661,822 | A | 4/1987 | Hirota et al. |
| 5,980,034 | A | 11/1999 | Tsai et al. |

(Continued)

FOREIGN PATENT DOCUMENTS

| | | |
|---|---|---|
| EP | 0 778 140 | 6/1997 |
| EP | 0 805 040 | 11/1997 |

(Continued)

OTHER PUBLICATIONS

Linx Printing Technologies production drawing No. AS20105/03, "Gutter Restrictor Assy", Jun. 7, 1993 (1 sheet).

(Continued)

*Primary Examiner* — Stephen Meier
*Assistant Examiner* — Jeremy Bishop
(74) *Attorney, Agent, or Firm* — Cozen O'Connor

(57) ABSTRACT

A gutter line of a continuous inkjet printer which includes a variable flow restrictor fitted into the gutter line, and a pressure transducer for measuring the pressure in the gutter line downstream of the variable flow restrictor, where the variable flow restrictor is controlled in response to the output of the pressure transducer to maintain a downstream pressure substantially constant. Airflow along the gutter line has a lower flow resistance than a slug of ink. Accordingly, the system responds dynamically to restrict the flow of air along the gutter line when no ink is passing along it, thereby reducing the volume of air sucked along the gutter line while maintaining adequate suction to reliably clear ink away from the gutter so that the amount of solvent lost from the ink is reduced during operation of an inkjet printer.

23 Claims, 6 Drawing Sheets

(56) References Cited

U.S. PATENT DOCUMENTS

| | | | | |
|---|---|---|---|---|
| 6,086,180 | A * | 7/2000 | Sugimoto et al. | 347/14 |
| 2006/0203054 | A1 * | 9/2006 | Matsuda et al. | 347/90 |
| 2007/0211132 | A1 * | 9/2007 | Lyons et al. | 347/190 |

FOREIGN PATENT DOCUMENTS

| | | | |
|---|---|---|---|
| EP | 1 700 700 | | 3/2006 |
| GB | 1 553 720 | | 8/1976 |
| GB | 2237898 | A * | 5/1991 |
| JP | 57-84855 | | 5/1982 |
| JP | 59-73957 | | 4/1984 |
| JP | 1-247167 | | 10/1989 |
| JP | 2-106354 | | 4/1990 |
| JP | 7-60993 | | 3/1995 |
| JP | 2002-154225 | | 5/2002 |
| WO | WO 98/17478 | | 4/1998 |
| WO | WO 99/62717 | | 12/1999 |
| WO | WO 02/100645 | | 12/2002 |
| WO | WO 2008/0117013 | | 10/2008 |

OTHER PUBLICATIONS

Linx Printing Technologies production drawing No. MP20033/02, "Restrictor Body", May 5, 1998 (1 sheet).

Linx Printing Technologies production drawing No. MP20034/02, "Restrictor Tube", May 5, 1998. (1 sheet).

Linx, "5000 Series Service Manual".

Linx, "4000/4200 Series Ink Jet Printer Service Manual" (1995).

* cited by examiner

VALVE DRIVE
R18 Therm 1K SO
R17 100R 0603
ZD3 3V3 SO
R2 8K2 0603
R4 910R 0603
R3 5K1 0603
R14 2K2 0603
L-59EGW-CA LED1
GREEN
RED
ZD2 3V3 SO
TR3 BC847 SO
TR2 BC847 SO
TR1 BD911
P1 Copper Pad
D1 SM4004 SO
C1 0.1µF 0603
IC1A
TLC2272ACD SO
R6 5K1 0603
R12 5K1 0603
R13 5K1 0603
IC1B
R1 680K 0603
C2 4.7µF Low Leakage SO
TR4 BC857 SO
R5 10K 0603
R11 1M 0603
R15 10K 0603
R16 5K1 0603
ENABLE
P5 Copper Pad
PT1
40PC Transducer
C9 4.7µF Low Leakage SO
15V
5V
0V
5
7
31
33
35
37
39
41
43
45
47
49
51
53
55
57
59
61
63
65
67
69
71

103
101
95
93
75
99
97
3
77
73
87
85
Flow
Restrictor
Valve
91
Valve
5
1
105
115
Venturi
81
107
89
Pump
Valve
Filter
83
Vent
111
113
Ink
Tank
Solvent
Tank
79
109

INKJET PRINTER AND FLOW RESTRICTION SYSTEM THEREFOR

RELATED APPLICATIONS

This is a U.S. National Phase Application under 35 U.S.C. §371 of International Application No. PCT/GB2008/004181, filed on Dec. 18, 2008, and claims priority on Great Britain application No. 0724961.8, filed on Dec. 21, 2007, the entire content of which is hereby incorporated by reference.

FIELD OF THE INVENTION

The present invention relates to inkjet printers of the type in which drops of ink which are not used for printing are caught in a gutter, and suction is used to drive ink along a line between the gutter and a destination for ink which has entered the gutter. Typically, the destination is an ink tank, from which the ink is re-circulated back to the ink jet. The present invention also relates to a flow control system for controlling fluid flow at a location in the line between the gutter and the suction source.

BACKGROUND OF THE INVENTION

Inkjet printers of the type discussed above are commonly referred to as continuous inkjet printers, as distinct from drop-on-demand inkjet printers, because ink drops continue to be provided even when they are not required for printing and, usually, a jet of ink will be provided continuously while the printer is in operation. Although unwanted ink drops may enter the gutter under their own momentum, it is necessary to provide suction at the gutter or not far behind it, in order to suck away the ink that has entered the gutter. This is particularly the case if the printer is to be operated in an arrangement such that the gutter is no higher than the intended destination for the recovered ink, so that it is impossible to transport the ink away from the gutter by gravity. One consequence of this use of suction is that the line conveying ink from the gutter to the suction source will normally also carry air, and in most commercial inkjet printers the volume of air flowing down this line is much greater than the volume of ink.

Various proposals have been made to modify the airflow in the line between the gutter and the suction source.

JP-A-02-106354 proposes that the cross-sectional area of the opening of the gutter should be smaller than the cross-sectional area of the pipe leading from the gutter to a suction pump, so that the airflow is faster near the gutter opening and it flows rapidly into the pipe, and is sucked at a lower speed along the pipe. This is intended to reduce the amount of solvent that evaporates from the ink.

GB 1553720 proposes an arrangement in which the gutter is connected by a short length of relatively large diameter tubing to a nearby separator, in which the ink and air that have entered the gutter are allowed to separate. A further relatively large diameter tube conveys air from the separator to a vacuum source. A second, relatively small diameter tube carries the ink from the separator to an evacuated ink return tank. By separating the ink from the air shortly after they have entered the gutter, this arrangement seeks to minimise the evaporation of solvent from the ink.

It is also known, e.g. from the Linx 5000 printer, to fit an insert into the line from the gutter to the suction source having a reduced internal cross-sectional area compared with the rest of the line, to act as a flow restrictor and thereby reduce the amount of air that is sucked into the gutter.

JP-A-07-060993 proposes that, because the level of suction required varies depending on the height of the printhead relative to the printer body containing a vessel for recovered ink, a device is provided in the line from the gutter to a suction pump in order to control the speed of flow along the line. When the printer is installed, this device is adjusted until just before the point that ink is no longer reliably collected from the gutter. Alternatively, the device may be adjusted beforehand, using a flow meter. Alternatively, a device having a fixed effect on the flow (by changing the bore of the line) may be used, and several such devices may be provided so that an appropriate one is selected and put in place before the printer is installed.

WO99/62717 proposes that the suction applied to the gutter should be intermittent or pulsed, either by interrupting the operation of an electric suction pump or by opening and closing a valve in the duct between the gutter and a venturi pump, in order to reduce the amount of solvent stripped out of the ink by the air which is sucked in through the gutter, and also to reduce aeration of the ink in the reservoir where it is collected.

WO02/100645 and JP-A-59-073957 both propose that recovered ink should be accumulated at the gutter until the amount of ink triggers a switch which operates a suction pump briefly to suck away the accumulated ink. In WO02/100645 this is intended to avoid various problems arising from sucking a large amount of air in through the gutter. In JP-A-59-073957 this is intended to allow a smaller and less expensive ink recovery pump to be used.

JP-A-57-084855 concerns an inkjet printer with a movable carriage, in which unwanted ink drops are collected by a gutter but recovery of ink from the gutter is not performed during printing but only when the carriage is stopped or is moving in a return direction. This is in order to prevent the gutter suction from affecting the printed characters.

EP 0805040 proposes a system in which the gutter is connected by a return line to an evacuated ink tank. The tank is initially set to a high vacuum level, creating "slug flow" in the return line, causing wide pressure swings in the return line as frothy slugs and liquid alternately travel past a pressure transducer. The tank vacuum is lowered until the pressure in the return line stops fluctuating, indicating a switch to "bubble flow", in which air in the return line takes the form of individual separate bubbles rather than frothy slugs.

JP-A-2002-154225 proposes that printing data is used to calculate the number of ink drops passing to the gutter per unit time interval, and that the speed of an ink recovery pump should be controlled accordingly, so that the pump generates a larger negative pressure when the flow of ink into the gutter is greater. This is intended to reduce the amount of solvent lost from the ink.

Alternative methods of reducing the loss of solvent from the ink, not affecting the path or the flow conditions of air down the line from the gutter are also known. For example, it is known to chill the air that has passed along the gutter line, as disclosed for example in JP-A-01-247167, in order to condense out evaporated solvent.

SUMMARY OF THE INVENTION

According to an aspect of the present invention there is provided a system for regulating the flow of fluid in a fluid path from a gutter of a continuous ink jet printer to a suction source, the system comprising a variable flow restrictor for adjusting the degree of flow restriction in a portion of the said flow path automatically in response to the fluid pressure in the said path at a location downstream of the said portion. Other aspects and optional features are set out in the claims.

According to another aspect of the present invention there is provided a system for adjusting the flow of fluid in a line from a gutter to a suction source in an inkjet printer, the system comprising an adjustable flow restrictor for restricting flow in the line, a pressure transducer for sensing fluid pressure in the line at a location downstream (i.e. towards the suction source) of the adjustable flow restrictor, and a control device for adjusting the amount of restriction applied by the flow restrictor to the line in response to the pressure detected by the pressure transducer so as to tend to increase the restriction to flow in response to an increase in the pressure (or a decrease in suction) and to decrease the restriction to flow in response to a decrease in the pressure (or an increase in suction).

Preferably, the system is arranged to maintain the pressure at the pressure transducer substantially constant.

Preferably, the components of the system are provided in a unit to be connected in the flowpath from the gutter to the suction source, the unit having a fluid inlet for connection to the path from the gutter and leading to the adjustable flow restrictor, a fluid outlet leading from the flow restrictor for connection to the fluid path to the suction source, and a connection to the pressure transducer between the adjustable flow restrictor and the fluid outlet.

This unit can conveniently be provided as a self-contained module which can be inserted into the gutter fluid path of an inkjet printer during manufacture, or perhaps in an operation to modify an existing printer. For example, in the case that a printhead of the printer, including the gutter, is removably connected to a main body of the printer, including the suction source, so as to allow exchange or replacement of the printhead, the module may be arranged to be provided in the printer main body for connection into the fluid path from the gutter to the suction source at the point where the line from the gutter is connectable to and disconnectable from the fluid path within the main printer body leading to the suction source.

The An embodiment of the present invention also includes: an inkjet printer having such a system in the flowpath between the gutter and the suction source; a printer body for an inkjet printer, connectable to a printhead, having such a system connected between a suction source in the printer body and a connection for receiving a line from a gutter of a printhead; a printhead connectable to an inkjet printer body and having such a system in a line from a gutter of the printhead to a connector for connection to a flowpath leading to a suction source of an inkjet printer body; and a connection unit (also known as a conduit or an umbilical) suitable for connecting a body of an inkjet printer to a remote printhead and carrying fluid lines for connection between the printer body and the printhead, comprising such a system in a line for connection between a gutter of a printhead and a suction source of a printer body.

Preferably, the system is connected so that most of the length of the fluid path from the gutter to the suction source is between the gutter and the pressure transducer. More preferably, at least 80% of the fluid path from the gutter to the suction source is between the gutter and the pressure transducer, and most preferably at least 90% of the flowpath from the gutter to the suction source is between the gutter and the pressure transducer.

Assuming that suction is applied to the gutter substantially continuously, rather than being applied only in response to the detection of an accumulation of ink at the gutter, the level of suction required to ensure that ink is reliably sucked away from the gutter and down the flowpath to the suction source typically results in a much greater volume of air passing down the flowpath from the gutter than the volume of ink. For example, the fluid flowing down the path may be more than 95% air by volume. The ink tends to travel in small accumulations or "slugs" which block the flowpath and are driven by the pressure differential between their upstream and downstream ends. The flow resistance of a slug of ink is normally much greater than the flow resistance of air in the flowpath. Consequently, when there is a slug of ink in the flowpath between the gutter and the pressure transducer, the pressure in the flowpath at the pressure transducer will be relatively low, because pressure will be dropped across the slug of ink upstream of the pressure transducer. However, when there is only air in the flowpath between the gutter and the pressure transducer the pressure at the transducer will be closer to atmosphere, because there will be less pressure drop along the flowpath upstream of the transducer. Accordingly, by increasing the flow restriction when the pressure at the transducer rises, the flow restrictor restricts flow when there is only air in the path from the gutter so as to reduce the amount of air sucked in by the suction source, but when a slug of ink is travelling along the gutter path the consequent reduction in pressure at the transducer results in a decrease in the restriction applied by the flow restrictor, so that the slug of ink is still sucked along reliably.

The operation of the flow restrictor under control from the pressure transducer tends to reduce the level of pressure fluctuations at the inlet to the suction source, as well as reducing the overall amount of air sucked into the flowpath. Since evaporation of solvent from the ink into the air which passes down the flowpath from the gutter is normally the most significant source of solvent loss during the operation of a continuous inkjet printer, this reduction in the airflow from the gutter to the suction source can also reduce the overall rate of solvent consumption of the printer.

It is possible to provide an adjustable flow restrictor which can respond to changes in an input control signal very rapidly, enabling a system to be constructed which responds substantially to the instantaneous state of flow in the flowpath from the gutter to the suction source, rather than responding only to average characteristics over a substantial period of time. The dynamic response of the system, so that flow of air is obstructed to a greater extent than the flow of ink, enables a reduction in the amount of air sucked into the suction source while maintaining the level of suction applied to ink.

BRIEF DESCRIPTION OF THE DRAWINGS

An embodiment of the present invention, given by way of non-limiting example, will now be described with reference to the following drawings.

DETAILED DESCRIPTION OF THE DRAWINGS

Figure 1:
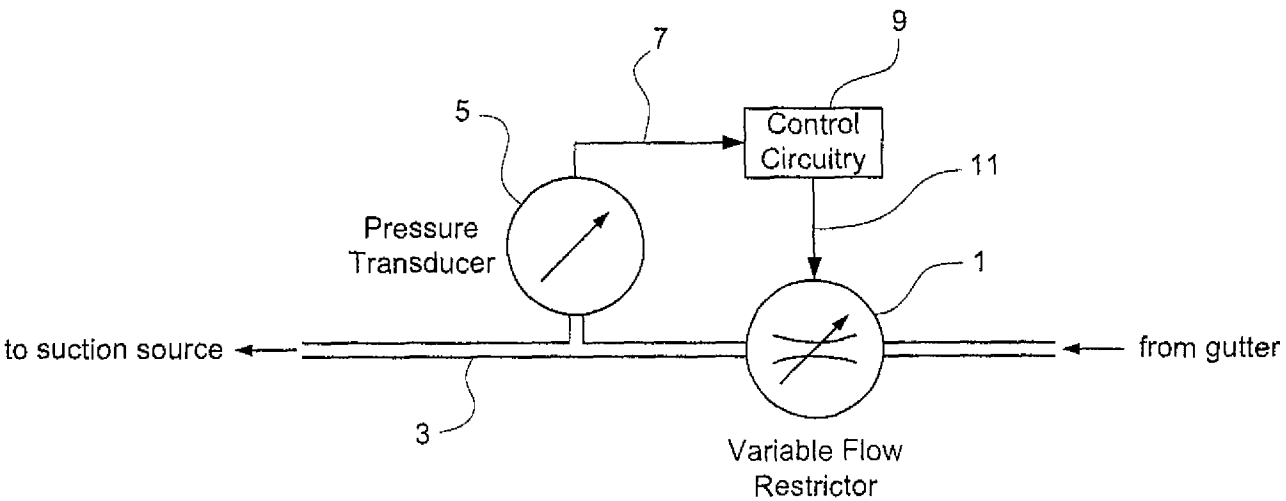
FIG. 1 shows a schematic arrangement of a fluid flow control system embodying the present invention.

FIG. 1 shows the arrangement of a fluid flow control system embodying the present invention. In the system of FIG. 1, a variable flow restrictor 1 is placed in the fluid line 3 between the gutter and the suction source. Immediately downstream of the variable flow restrictor 1, a branch from the fluid line 3 leads to a pressure transducer 5. The pressure transducer 5 measures the pressure in the fluid line 3 downstream of the variable flow restrictor 1, and it provides a pressure value signal on a line 7 which is input to control circuitry 9 for controlling the variable flow restrictor 1. The control circuitry 9 provides a signal on a line 11 to the variable flow restrictor 1, controlling the degree to which the variable flow restrictor 1 restricts the flow of fluid through it.

The control circuitry 9 is set up so as to have a reference value which corresponds to a target value for the pressure in the fluid line 3 downstream of the variable flow restrictor 1, and it is arranged so that it tends to reduce the degree to which flow is restricted, thereby allowing increased flow from the gutter, when the value received from the pressure transducer 5 indicates that the pressure in the fluid line is lower than the target value, and it tends to increase the degree of flow restriction, thereby reducing the flow of fluid from the gutter, when the value received from the pressure transducer 5 indicates that the pressure in the fluid line 3 is above the target value. In this way, a negative feedback loop is formed by the pressure transducer 5, the control circuitry 9 and the variable flow restrictor 1 which tends to stabilise the pressure in the fluid line 3 downstream of the variable flow restrictor 1.

If a slug of ink enters the fluid line 3 from the gutter, its higher flow resistance as compared with air means that pressure is dropped across it and the fluid pressure at the pressure transducer 5 tends to fall. As a result, the control circuitry 9 controls the variable flow restrictor 1 so as to reduce the degree to which it restricts the flow of fluid through it, so that the variable flow restrictor 1 does not excessively restrict the flow of the slug of ink. However, once the ink has passed down the line 3 to the suction source and there is only air in the line 3, the pressure at the pressure transducer 5 will rise to become closer to the atmospheric pressure available at the gutter. As a consequence, the control circuitry 9 will control the variable flow restrictor 1 to increase the degree to which flow through it is restricted, thereby reducing the flow of air down the fluid line 3. In this way, the system shown in FIG. 1 is able to respond dynamically to changes in the state of the fluid line 3, so as to restrict the flow of air down the line while nevertheless permitting ink to flow substantially unrestricted, or with less restriction than is applied to the flow of air.

Figure 2:
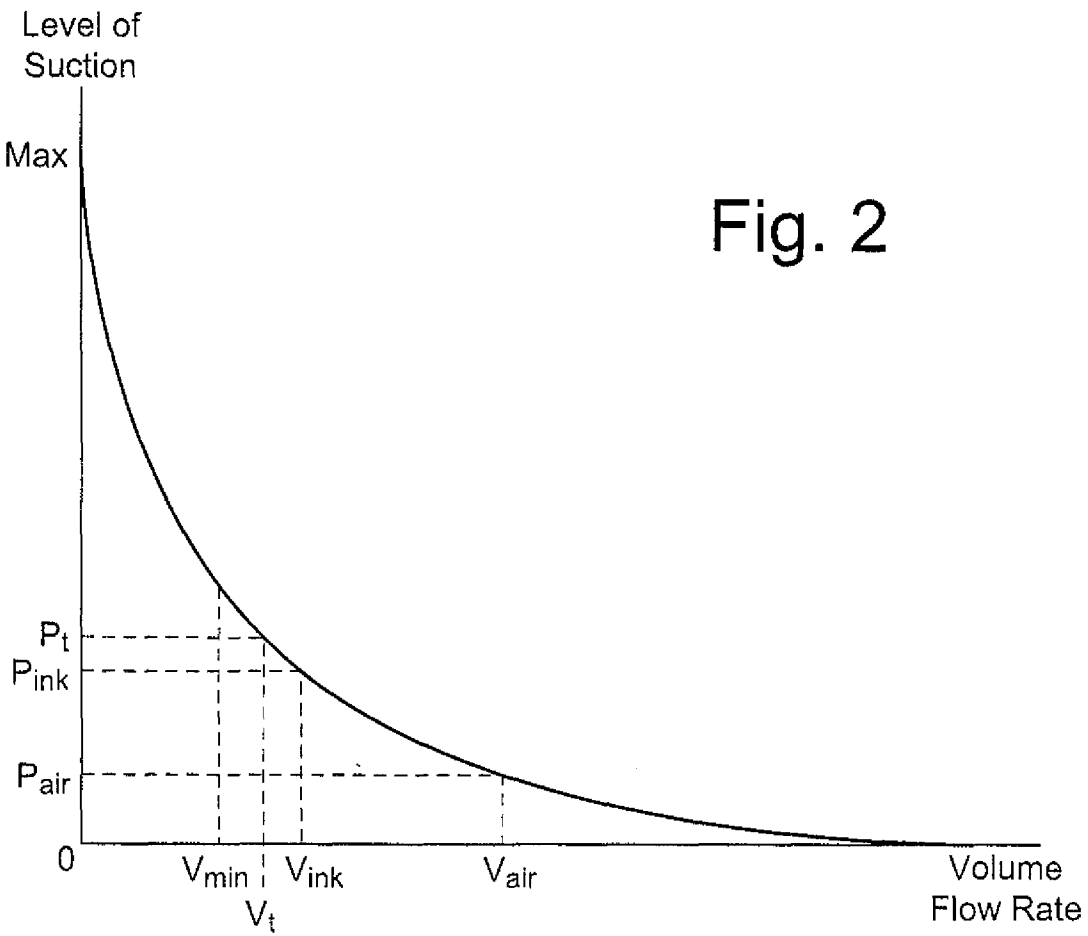
FIG. 2 shows a schematic plot of suction against volume flow rate for a suction device in an inkjet printer.

The effect of the fluid flow control system of FIG. 1 is illustrated in FIG. 2. FIG. 2 is a graph showing the level of suction, as measured by the pressure transducer 5, against the volume flow rate down the fluid line 3. If all flow down the fluid line 3 was prevented, the suction source would develop its maximum possible level of suction, marked as "Max" in FIG. 2 (i.e. the lowest possible pressure). If a small amount of flow is permitted in the fluid line 3, the level of suction drops considerably (i.e. the pressure rises). As the rate of flow increases, the level of suction drops further. In FIG. 2, the plot is extended to the theoretical limit, in which the fluid line 3 provides no flow resistance at all and the pressure transducer measures no suction (i.e. it detects atmospheric pressure), although in reality this point is never reached since the fluid line 3 will inherently provide some flow resistance whatever fluid is flowing down it. The maximum possible level of suction and the shape of the curve will be determined by the characteristics of the suction source and the fluid line 3, and will vary depending on the particular components used.

In the absence of the variable flow restrictor 1, the flow in the fluid line 3, while a slug of ink is passing down the fluid line, will typically be at a flow rate $V_{ink}$, and the suction source will generate a pressure $P_{ink}$ at the pressure transducer 5. In practice, the flow rate and level of suction will depend on the size of the slug of ink, and will also vary if more than one slug of ink is in the fluid line 3 at the same time, as these factors will affect the overall level of flow resistance within the fluid line 3. If there is no ink in the fluid line 3, and only air is flowing, the volume flow rate is $V_{air}$, at a pressure of $P_{air}$. Because air has a lower flow resistance down the fluid line 3 than ink, a greater volume flows at a lower level of suction (i.e. higher pressure at the pressure transducer 5) as compared with the flow of ink. These values will depend on the design of the system, and can be determined experimentally if necessary. FIG. 2 also shows the minimum permitted flow rate $V_{min}$, which must be maintained in order to ensure that ink is reliably cleared from the gutter and does not tend to dribble back out of the gutter orifice during operation. Again, this value can be determined experimentally if necessary.

Once these values have been determined, the target value $P_t$ for the pressure at the pressure transducer, during the operation of the fluid control system of FIG. 1, can be chosen, and this will correspond to a volume flow rate $V_t$. As shown in FIG. 2, the target pressure value $P_t$ is preferably chosen so as to be a lower pressure, and therefore a higher level of suction, than $P_{ink}$, so that some flow restriction is applied even when a slug of ink is flowing along the fluid line 3. Since part of the fluid line 3 will contain air even while a slug of ink is flowing along the fluid line, this serves to reduce the rate at which air is sucked into the fluid line even while a slug of ink is flowing down it. However, the pressure target value $P_t$ should be chosen so that the corresponding volume flow rate $V_t$ is nevertheless greater than the minimum permitted volume flow rate $V_{min}$ by a sufficient safety margin to ensure robust and reliable clearing of ink from the gutter even though the fluid control system is restricting flow down the fluid line 3.

In operation, the fluid control system will respond dynamically to the pressure in the fluid line 3 so as to hold the pressure substantially at $P_t$, with the result that the volume flow rate down the fluid line 3 is substantially constant at $V_t$. The difference between $V_t$ and the unrestricted volume flow rate of air $V_{air}$ represents the extent to which the volume of air flowing down the fluid line 3 is reduced. As can be seen from FIG. 2, by holding the actual volume flow rate $V_t$ at or below the unrestricted flow rate for ink $V_{ink}$, a substantial reduction in the flow rate of air can be achieved.

Figure 3:
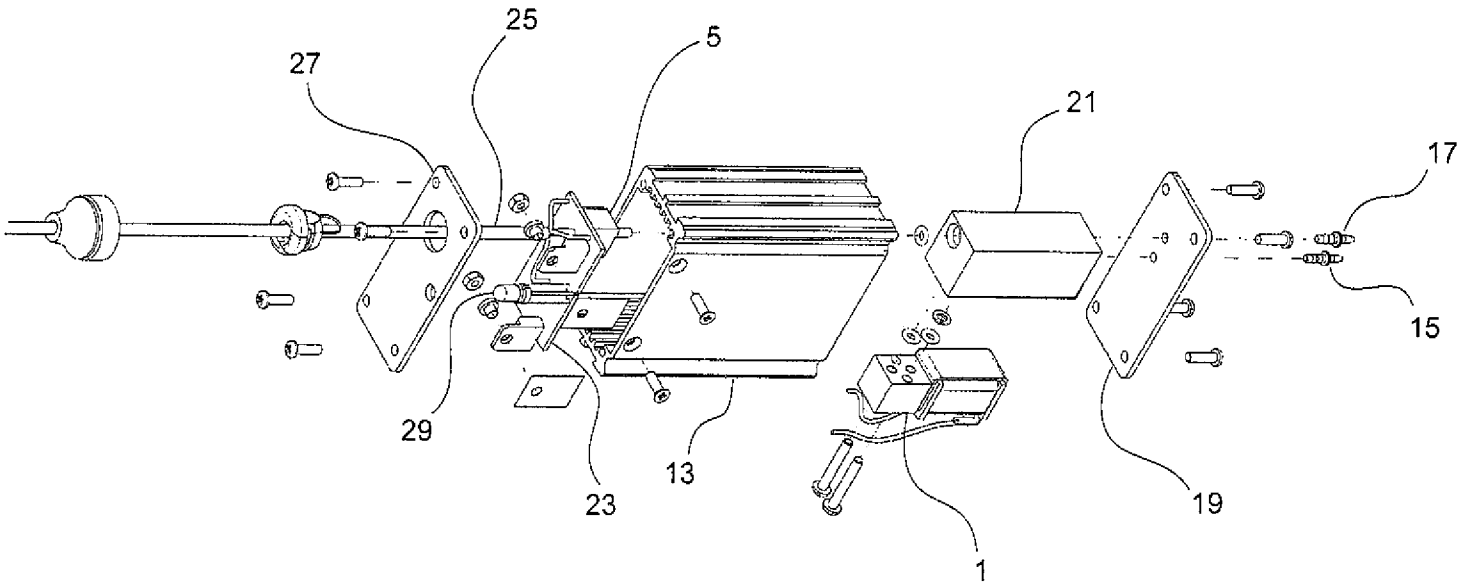
FIG. 3 is an exploded view of a substantially self-contained module comprising a fluid flow control system embodying the present invention.

FIG. 3 shows an exploded view of the physical construction of a module for insertion in the fluid line 3 between the gutter and a suction source, containing a fluid flow control system embodying the invention as discussed with reference to FIG. 1. In FIG. 3, the main parts of the system are housed within a main body 13. A fluid inlet pipe connection 15 and a fluid outlet pipe connection 17, for connection to the line from the gutter and for connection to the line to the suction source respectively, are fitted in an end wall 19. The pipe connections 15, 17 are connected within the module to a manifold 21, to which the variable flow restrictor 1 is attached. The manifold 21 connects fluid received from the fluid inlet pipe connection 15 to the inlet side of the variable flow restrictor 1, and connects fluid received from the outlet side of the variable flow restrictor 1 to the fluid outlet pipe connection 17. In this embodiment, the variable flow restrictor is a VSO proportional solenoid valve from Pneutronics, of 26 Clinton Drive, Unit 103, Hollis, N.H. 03049, USA (website www.pneutronics.com). The Pneutronics VSO valve controls the flow of fluid through it in proportion to the input current, and it may be driven with continuous DC current or by pulse width modulation.

The manifold 21 also provides a branch in the fluid path from the variable flow restrictor 1 to the fluid outlet pipe connection 17, for receiving the pressure transducer 5. In this embodiment, the pressure transducer is a Honeywell 40PC pressure transducer. Both the Pneutronics VSO valve and the Honeywell 40PC pressure transducer are available in the United Kingdom from Sensortechnics (or Pressure and Flow Limited), Victoria House, 50 Albert Street, Rugby, Warwickshire, CV21 2RH, United Kingdom.

The pressure transducer 5 is mounted on a circuit board 23 which also carries the control circuitry 9. Electrical wiring to supply power, and also an "enable" signal to be described later, pass through the circuit board 23, enter a protective sleeve 25, and pass through the other end wall 27 of the module. An indicator light 29, containing a green LED and a red LED, fits through a hole in the end wall 27 to show the operating status of the module.

In this way, a substantially self-contained module is provided which can be fitted in an inkjet printer, connected into the fluid path from the gutter to the suction source at any convenient place, preferably within the printer main body, and electrical connections may be made within the printer to receive power and the "enable" signal.

Figure 4:
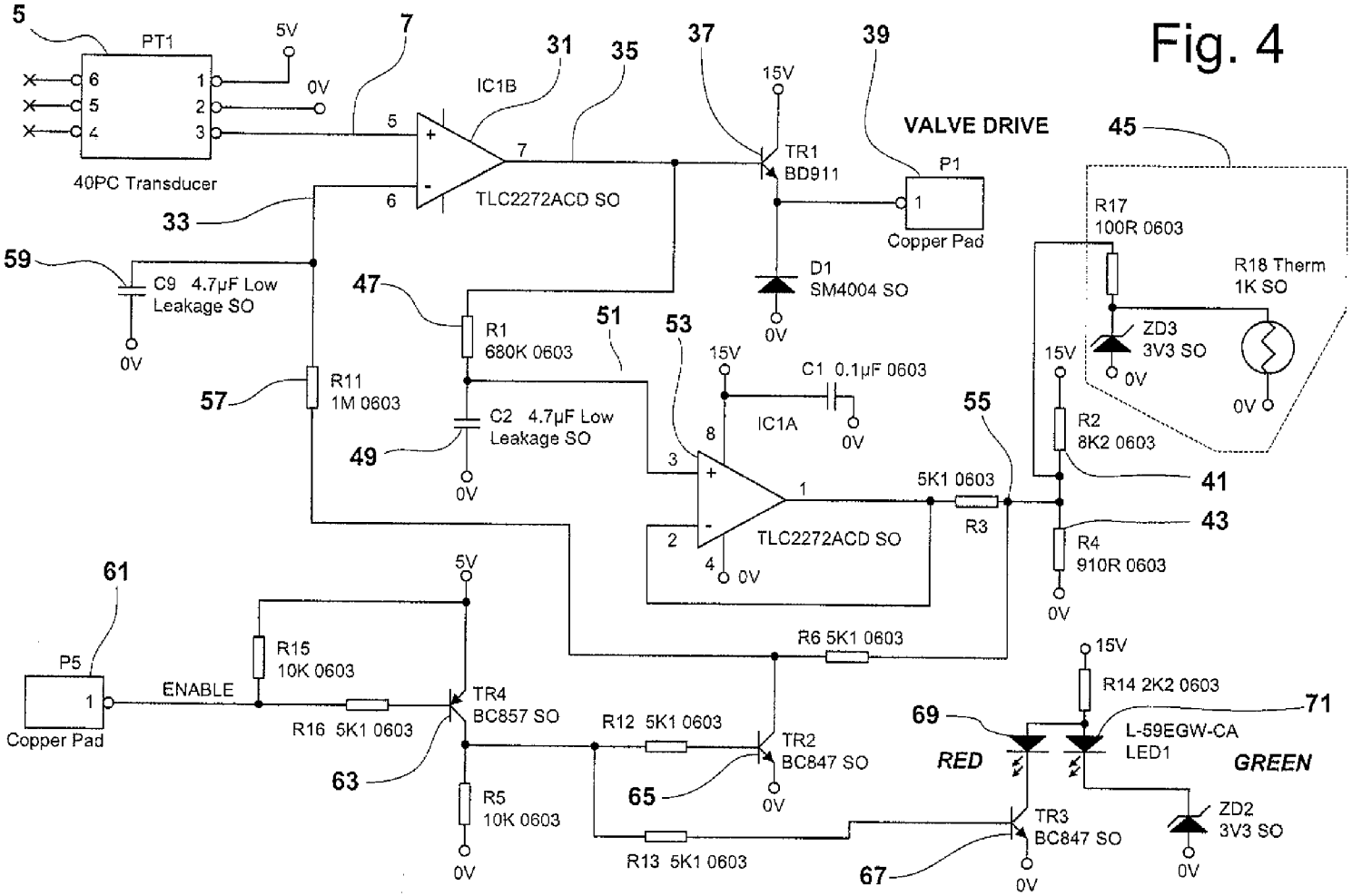
FIG. 4 is a circuit diagram for a control circuit used in the module of FIG. 3.

FIG. 4 is a circuit diagram of an example of the control circuitry 9 suitable for use with the Pneutronics VSO valve and the Honeywell 40PC pressure transducer.

The circuit of FIG. 4 makes use of the fact that in many printers the pressure in the fluid line from the gutter is not stable, but has an irregular audio frequency ripple, which in practice can often be heard by an operator. The circuit uses this audio frequency noise to create an audio frequency pulse width modulated drive signal for the variable flow restrictor 1. In the circuit, the signal from the pressure transducer 5 on the line 7 is input to the non-inverting terminal of an operational amplifier 31. In FIG. 4, the Honeywell 40PC pressure transducer is set up as a differential transducer, responding to the difference between the ambient pressure and the pressure in the fluid line 3. As the pressure in the fluid line 3 falls, i.e. as suction increases, the signal voltage output by the transducer rises.

A comparison value is input to the inverting terminal from line 33. Because of the audio frequency noise, the signal level on line 7 is rapidly varying. If it is assumed initially that the average level on line 7 is the same as the level on line 33, then the effect of the audio frequency noise is that the signal on line 7 will be higher than the comparison value on line 33 for about half the time and will be lower than the comparison value on line 33 for about half the time. Consequently, the operation of the op amp 31 has the effect that its output on line 35 is an irregular audio frequency square wave signal having approximately a 50% duty ratio. This provides the drive signal for the Pneutronics VSO valve being used as the variable flow restrictor 1. The signal is buffered (and current-amplified) by a transistor 37 and output to a connection pad 39 for supply to the variable flow restrictor 1. If the pressure in the fluid line 3 falls slightly (the suction increases), the average value of the audio frequency noise signal on line 7 from the pressure transducer 5 will rise slightly, with the result that it will now be higher than the comparison value provided on line 33 for a greater proportion of the total time, thereby increasing the duty ratio of the drive signal output on line 35 from the operational amplifier 31. The Pneutronics VSO valve is a normally closed valve, so that the increased duty ratio of the drive signal tends to make it open further than its previous position, reducing the flow restriction, which is the desired response to the reduction in pressure sensed by the pressure transducer.

Conversely, if the pressure in the fluid line 3 rises slightly, the average value of the audio frequency noise signal on line 7 will fall slightly, and it will be greater than the comparison value on line 33 for a smaller proportion of the time, so that the duty ratio of the drive signal will reduce. In this way, the comparison between the audio frequency noise on line 7 and the comparison value on line 33 generates the pulse width modulated drive signal for the variable flow restrictor 1. "Audio frequency" means a frequency in the range of 20 Hz to 20 kHz. In practice, in the system of FIGS. 3 and 4 using the Honeywell 40PC pressure transducer the frequency of the drive signal supplied to the Pneutronics VSO valve tends to be about 1 kHz.

The variation in the pressure in the fluid line 3, between the pressure when a slug of ink is passing down the line and the pressure when the line only contains air, is greater than the amplitude of the audio frequency noise. Consequently, if the comparison value on the line 33 remains constant, there will be periods during which the range of variation of the pressure signal on line 7 due to the audio frequency noise will not include the comparison level, but will be entirely above it or entirely below it, with the effect that the drive signal output on line 35 from the operational amplifier 31 will be continuously at a high level or continuously at a low level, instead of being an audio frequency pulse signal. This will tend to drive the variable flow restrictor 1 to fully open or fully closed. In practice, such an extreme response is not desirable. Therefore, in order to prevent comparison value on line 33 from being outside the range of values on line 7, or to return the comparison value to within the range if it is outside it, the level of the comparison value on line 33 is permitted to vary so as to track, to some extent, the average value on line 7. However, a rest value for the comparison signal, corresponding to the desired target pressure $P_t$ for the fluid line 3, is defined by a potential divider formed by resistors 41, 43. The potential divider is provided with a temperature compensation network 45.

The drive signal on line 35 is integrated by an RC circuit formed by resistor 47 and capacitor 49. The resulting signal, on line 51, represents the average value of the pulse width modulated drive signal, and therefore represents the difference between the average value of the pressure signal on line 7 and the comparison signal on line 33. This average difference value on line 51 is buffered by an operational amplifier 53. The buffered average difference value from the operational amplifier 53 and the desired fluid pressure value from the potential divider 41, 43 are combined at analogue summing junction 55. Accordingly, the voltage level at junction 55 represents a compromise between the average drive signal level and the desired fluid pressure value. The value at junction 55 is smoothed by a further RC circuit comprising resistor 57 and capacitor 59, to create the comparison value signal on line 33 input to the operational amplifier 31.

Accordingly, the feedback loop provided by the RC circuit 47, 49, the buffer operational amplifier 53 and the RC circuit 57, 59 has the effect that when the difference between the comparison value on line 33 and the average of the pressure signal on line 7 increases, the level of the comparison value changes to reduce that difference, but the effect of the desired fluid pressure value provided by the potential divider 41, 43 means that the change in the comparison value on line 33 is reduced, and an appropriate difference from the average pressure value on line 7 is maintained, so that the pulse width of the drive signal on line 35 is modulated appropriately.

In effect, the feedback circuit ensures that the comparison value remains within range of the audio noise fluctuations superimposed on the pressure value signal on line 7 (or rapidly re-enters that range), so as to ensure that the drive signal to the variable flow restrictor 1 maintains its pulse form. On the other hand, the potential divider 41, 43 imposes an appropriate difference between the comparison value on line 33 and the average of the pressure value on line 7 in order to ensure that the duty cycle of the drive signal on line 35 is varied appropriately, i.e. that the width of the pulses is modulated appropriately.

Figure 5:
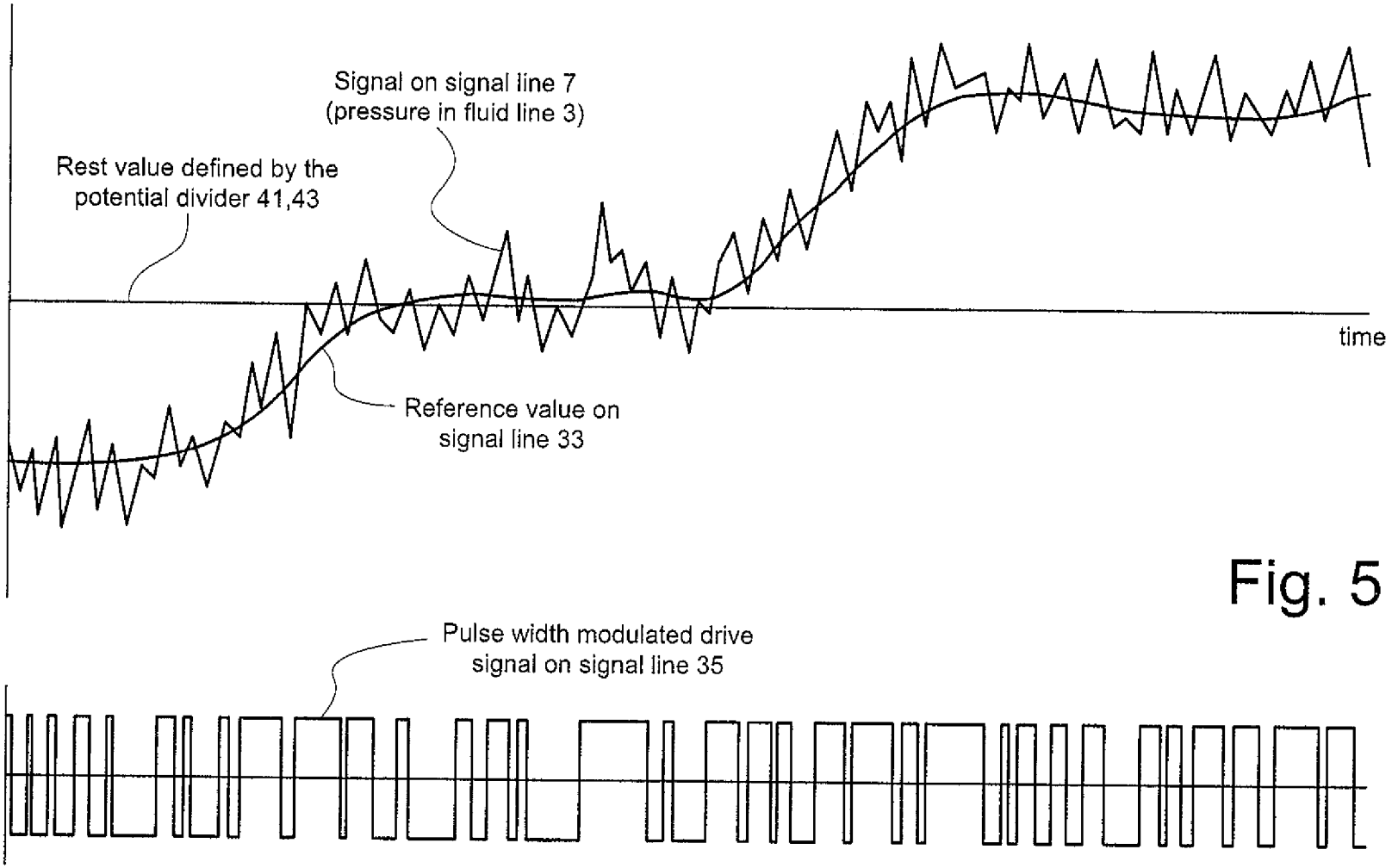
FIG. 5 illustrates the operation of a reference level control system in the circuit of FIG. 4.

The effect of the feedback loop and the potential divider is illustrated schematically in FIG. 5. As shown in the upper part of FIG. 5, a rapidly varying signal on line 7 has an average value which varies over time by an amount that is greater than the amplitude of its rapid variations. The actual waveform shown in FIG. 5 for the signal on line 7 is not intended to be a realistic representation of the pressure fluctuations in the fluid line 3, but is provided merely for the purposes of illustration of the operation of the feedback loop and potential divider in the circuit of FIG. 4. As also shown in the upper part of FIG. 5, the comparison value on line 33 moves up and down in response to changes in the average value of the pulse width modulated drive signal on line 35. The pulse width modulated signal on line 35, generated by the op amp 31 from the signals on lines 7 and 33, is shown in the lower part of FIG. 5. If the average value of the pressure signal on line 7 rises, there is an increase in the proportion of the time that it is above the comparison value on line 33, so that the duty ratio of the PWM signal on line 35 increases. Consequently the average value of the signal on line 35 increases, causing a rise in the comparison value on line 33. This in turn reduces the duty ratio and the average value of the signal on line 35. In this way, the system stabilises at a new comparison value. However, the comparison value is pulled towards the rest value by the potential divider 41, 43, so that the higher the comparison value on line 33, the higher the duty ratio on line 35 required to create it. Therefore, the comparison value on line 33 will stabilise at a level closer to the rest value defined by the potential divider 41, 43 than the average value of the signal on line 35 is to the rest value.

Consequently, at the left-hand end of FIG. 5, where the signal on line 7 is below the rest value defined by the potential divider 41, 43, the signal on line 7 is lower than the comparison value on line 33 for most of the time, and therefore the square wave pulse width modulated drive signal on line 35 (shown in the lower part of FIG. 5) has a duty ratio of less than 50% (i.e. the signal is normally at a low level). Conversely, at the right-hand end of FIG. 5, where the signal on line 7 is higher than the rest value defined by the potential divider 41, 43, the signal on line 7 is normally higher than the comparison value on line 33 so that the duty ratio of the square wave pulse width modulated drive signal on line 35 is greater than 50% (i.e. the signal is normally at a high level). Because the level of the comparison value on line 33 varies, so as to remain within the range of fluctuation of the signal on line 7, the drive signal on line 35 is a high frequency pulse width modulated signal, and does not tend to remain continuously at the same level.

In practice, the average value of the pressure signal on line 7 may change more quickly than the comparison value on line 33 is able to track, with the result that the range of fluctuations of the pressure signal on line 7 does not include the comparison value for a brief period. Consequently, the drive signal on line 35 may remain continuously high or continuously low, driving the Pneutronics VSO valve towards fully open or fully closed, until the comparison value catches up and re-enters the range of fluctuations of the signal on line 7. While the drive signal on line 35 is continuously high or continuously low, its average value tends towards maximum or minimum, causing the comparison value to change rapidly in the required direction. Once the comparison value on line 33 has re-entered the range of fluctuations, the signal on line 35 will return to pulse form.

The system of FIGS. 3 and 4, using the Pneutronics VSO valve and the Honeywell 40PC pressure sensor, can respond to a change in pressure in the fluid line 3, representing a change in the fluid in the line from solely air to a slug of ink or vice versa, by varying the amount of flow restriction to return the pressure at the pressure transducer 5 to substantially the target value within about 160 ms. Accordingly the system is able to respond dynamically to changes in the state of the fluid line. Preferably, the flow restrictor 1 should begin to respond to a change in pressure of the pressure transducer within about 2 seconds, more preferably within about 1 second, still more preferably within about 0.5 of a second and most preferably within 250 ms. More preferably, the system should return the pressure at the pressure transducer 5 to substantially the target value within these periods.

During operation of the inkjet printer, it may be desirable to turn off the dynamic flow control system during certain procedures. For example, it will normally be desired to maintain full suction on the line from the gutter during the operations for starting and stopping the inkjet. Additionally, it is necessary to add further solvent to the ink from time to time, to replace solvent lost due to evaporation, and in some printers this is done by sucking a dose of solvent into the ink flow using the same suction source as is used to generate the suction applied to the gutter, with the effect that the suction applied to the gutter may fluctuate slightly during an operation for adding solvent. Consequently, it may be desired to turn off the dynamic flow control system while solvent is added, in order to prevent any fluctuations in the level of suction from triggering inappropriate behaviour at the variable flow restrictor 1. Accordingly, an arrangement is provided for the circuit of FIG. 4 to receive the "enable" signal, previously mentioned, from the main control system of the printer. A contact pad 61 is provided for receiving this signal. The "enable" signal is buffered and inverted by a transistor 63, and is then used to switch a transistor 65 which is connected to the feedback loop between the analogue summing junction 55 and the RC circuit 57, 59.

Consequently, if the "enable" signal is high, the voltage input to transistor 65 is low and the transistor is turned off, so that it has no effect on the operation of the feedback loop. However, if the "enable" signal goes low, the signal input to transistor 65 will go high, turning the transistor on and pulling the reference value on line 33 down to a low value. This means that the pressure value on line 7 from the pressure transducer 5 will be reliably higher than the reference value on line 33 whatever the pressure in the fluid line 3, so that the output signal on line 35, used to drive the variable flow restrictor 1, becomes continuously high and the flow restrictor is driven into its minimum restriction position and held there. When the "enable" signal goes high again, the voltage applied to the base of transistor 65 will go low, the transistor will switch off, and the value from the analogue summing junction 55 will be used once again to generate the reference value on line 33, returning the circuit to normal operation.

The signal output from the buffering and inverting transistor 63 is also input to a switching transistor 67 for the indicator light 29. When the voltage input to the base of transistor 65 is high, disabling the dynamic flow control system, the switching transistor 67 is also turned on, with the result that a red LED 69 lights up. When the voltage input to the base of transistor 65 goes low, so that the flow control system is in its normal active state, the switching transistor 67 is turned off with the effect that the red LED 69 turns off and a green LED 71 turns on. The LEDs 69, 71 are both encapsulated in the indicator light 29, to provide a colour signal indicating the state of the system.

FIG. 4 shows an example of a hardware electronic control circuit. However, a programmable interface controller or similar device could be used to implement the same logical behaviour under software control. Other control circuits are possible, and may for example provide a steady analogue drive signal rather than a pulse-width modulated square wave signal. However, the pulse width modulated signal has the advantage that the drive transistor 37 is either fully on, with low resistance, or fully off, with low current, which helps to minimise heat generation within the transistor. The circuit of FIG. 4 has been designed specifically to meet the characteristics of the Honeywell 40PC pressure transducer and the Pneutronics VSO valve. Other circuit designs may be appropriate with other components, and for example a signal inverter may be provided if required in view of the polarities of the pressure transducer output and the flow restrictor input.

Figure 6:
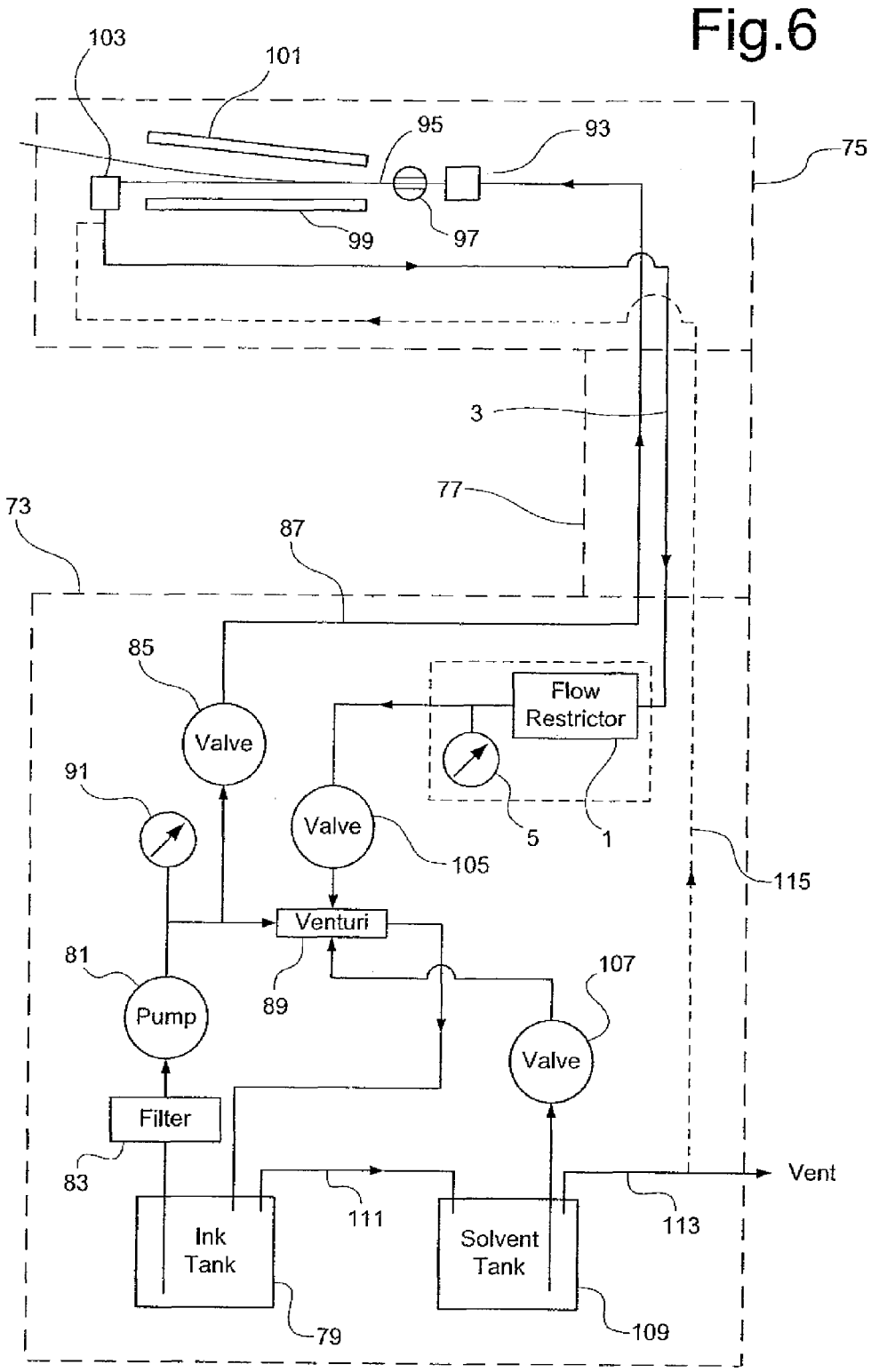
FIG. 6 is a schematic diagram of part of the fluid circuit of an inkjet printer, including a fluid flow control system embodying the present invention.

Many variations in the flow control system are possible. In the example shown in the drawings, the flow control system is arranged so that it seeks to keep the pressure at the pressure transducer at a preset constant value. However, other control regimes are possible and a system that merely increases the flow restriction as pressure rises (suction reduces) and reduces flow restriction as pressure falls (suction increases), without any specific pressure target, will provide some benefit, FIG. 6 is a schematic diagram of part of the fluid circuit of an inkjet printer embodying the present invention. Parts of the fluid system relating to printhead flushing operations and purge operations have been omitted for simplicity.

In the printer of FIG. 6, the fluid tanks, valves and most other fluid-handling components, together with most of the electrical components of the printer, are housed in a main printer body 73. Printing is performed by a printhead 75, where the inkjet is formed. The printhead 75 is connected to the main printer body 73 by a flexible connection 77 commonly known as a conduit or umbilical. This carries fluid and electrical connections between the main printer body 73 and the printhead 75, and is typically in the range of 1 metre to 4 metres long.

In the arrangement shown in FIG. 6, ink used to form the ink jet is held in an ink tank 79. During operation of the printer, ink is withdrawn from the ink tank 79 by an ink pump 81, via a filter 83. While the ink jet is flowing, an ink feed valve 85 allows ink pressurised by the ink pump 81 to flow into an ink feed line 87, which conveys ink through the umbilical 77 to the printhead 75. Even when the ink jet is running, the amount of ink flowing through the ink feed valve 85 into the ink feed line 87 will normally be a small proportion of the total flow through the ink pump 81, and most of the ink flow passes instead through a venturi suction device 89 and back into the ink tank 79. As well as having an ink inlet and an ink outlet, the venturi suction device 89 has one or more suction inlets, and it generates suction at the suction inlet or inlets using the Venturi effect. The ink pressure downstream of the ink pump 81 is monitored by an ink pressure transducer 91, and the ink pump 81 is controlled in order to keep the ink pressure at a desired value. This desired value may change during operation of the printer, depending on various operational parameters and also depending on the actions being performed by the printer (for example, the pressure may be varied during routines for starting and stopping the ink jet, both for the purpose of adjusting the amount of suction provided by the venturi suction device 89 and for controlling the ink pressure at the moment the jet is stopped or started, at which times different ink pressures may be used as compared with the ink pressure while the jet is running normally).

Ink which flows up the ink feed line 87 to the printhead 75 is supplied to an ink gun 93, where it flows out through a small nozzle to form the ink jet 95. The ink jet 95 leaves the ink gun 93 as a continuous stream, but breaks into drops while it is passing through a slot or hole in a charge electrode 97. A continuous pressure vibration is applied to the ink by the ink gun 93 in order to control the manner in which the jet breaks into drops. The ink is electrically conductive and the ink gun 93 is held at ground potential. Accordingly, by varying the voltage on the charge electrode 97, variable amounts of electrical charge can be captured on the ink drops as they separate from the continuous portion of the ink jet 95. The ink drops then pass through an electric field generated by deflection electrodes 99, 101. Typically, deflection electrode 99 will be maintained at ground potential whereas deflection electrode 101 will be maintained at a potential of several thousand volts, thereby creating a strong electric field between them. As the ink drops pass through this field, they are deflected to an extent which depends on the amount of charge trapped on each respective drop. In this way, the drops are steered to the positions required for printing. The ink jet 95 runs continuously, and many ink drops will not be required for printing. In the arrangement of FIG. 6, these drops are not charged by the charge electrode 97 and accordingly they pass through the deflection field without being deflected, and are caught by the gutter 103. The ink entering the gutter 103 is sucked along the gutter line 3, through the umbilical 77 and into the main printer body 73, by suction supplied from a suction port of the venturi suction device 89 through a gutter suction valve 105. The ink then joins the ink flow from the venturi suction device 89 back to the ink tank 79.

Sensor electrodes in the printhead 75, which are conveniently mounted on the grounded deflection electrode 99 (as described in U.S. Pat. No. 6,357,860) but which may alternatively be provided separately, detect charged drops and are used to measure the speed of the ink jet. The pressure generated by the ink pump 81, and measured by the ink pressure transducer 91, is adjusted to keep the jet velocity substantially at a predetermined desired value. As solvent is lost from the ink circulating from the ink tank 79 through the ink gun 93, along the ink jet 95, into the gutter 103 and back to the ink tank 79, the pressure required to maintain the desired ink jet velocity will increase. When this pressure exceeds a predetermined limit, a solvent top-up valve 107 is opened briefly, allowing the venturi suction device 89 to suck a small quantity of solvent out of a solvent tank 109 into the ink stream being returned to the ink tank 79. As this small quantity of solvent mixes into the ink, the ink viscosity is reduced and accordingly the ink pressure required to maintain the correct jet velocity falls again.

As discussed above, the level of suction required from the venturi suction device 89 through the gutter line 3 to the gutter 103 means that a substantial volume of air is inevitably sucked along the gutter line 3 in addition to the ink which enters the gutter 103 from the ink jet 95. This air will be sucked into the venturi suction device 89 and will pass into the ink tank 79 along with the ink. This air is allowed to leave the ink tank 79 by an air line 111, which connects the air space at the top of the ink tank 79 with the air space at the top of the solvent tank 109. The air is then vented to atmosphere from the solvent tank 109 along a vent line 113. This maintains the ink tank 79 and the solvent tank 109 at atmospheric pressure. Optionally, some of the air passing along the vent line 113 may return to the printhead along an air recirculation line 115 (as shown in a broken line in FIG. 6) and join the ink flow path, from the gutter 103 to the venturi suction device 89, in or near the gutter 103 (as disclosed in GB application 0705902.5). By returning some of the air that has passed along the gutter line 3 back to a point near the beginning of the gutter line 3, the amount of fresh air which enters through the gutter 103 is reduced, and the amount of air vented to atmosphere from vent line 113 is reduced. This is useful, since the air passing along the gutter line 3 comes into intimate contact with the ink and tends to become saturated with solvent vapour, and the discharge of this air to atmosphere is normally the most significant loss of solvent during operation of an inkjet printer.

As shown in FIG. 6, the flow control system of FIGS. 1 to 5 is connected in the gutter line 3 at a position inside the main printer body 73. As previously discussed, the flow control system applies a greater restriction on the flow of fluid along the gutter line 3 when there is only air in the gutter line 3 than when there is ink passing along it. Accordingly, it maintains sufficient suction and flow along the gutter line 3 while ink is present, so as to ensure that ink is reliably moved along the gutter line 3 and does not accumulate at the gutter 103, while reducing the amount of air passing along the gutter line 3 at other times. This reduces the overall flow of air along the gutter line 3, and consequently reduces the overall discharge of air to atmosphere from the vent line 113, consequently resulting in a reduction in the amount of solvent lost from the printer.

Various types of fluid system are known for continuous inkjet printers, and the arrangement shown in FIG. 6 is merely one possible arrangement, provided as a non-limiting example. Many variations are possible. For example, in the arrangement of FIG. 6 the ink and solvent are stored in tanks at atmospheric pressure, a pump is used to withdraw ink from the ink tank and pressurise it, the pressurised ink passes through a venturi device to generate suction as needed in the printer, and solvent is added to the ink when required by being sucked into the ink flow by the venturi suction device. However, either or both of the ink tanks could be pressurised, implying a different arrangement of pumps. A different device could be used to generate suction, such as a pump. Solvent could be transferred into the ink tank by a different arrangement, such as by a dedicated pump which transfers solvent directly into the ink tank or by maintaining a pressurised solvent tank at a higher pressure than the ink tank. Many further alternatives will be apparent to those skilled in the art.

The embodiments discussed above are provided by way of non-limiting example, and many alternatives and modifications will be apparent to those skilled in the art. Accordingly, the present invention should be regarded as encompassing all matters falling within the scope of the claims.

The invention claimed is:

1. A system configured to regulate the flow of fluid in a fluid path from a gutter of a continuous ink jet printer to a suction source, the system comprising a variable flow restrictor arranged to adjust a degree of flow restriction in a portion of the fluid path automatically in response to fluid pressure in the fluid path at a location downstream of the portion.

2. The system according to claim 1, comprising a control means arranged to sense said fluid pressure and control the variable flow restrictor in response thereto.

3. The system according to claim 2, wherein the control means comprises a pressure sensor arranged to sense the pressure in the fluid path and a control circuit arranged to receive an output from the pressure sensor and provide in response thereto a control signal to the variable flow restrictor.

4. The system according to claim 3, wherein the control signal is a pulse-width modulated signal.

5. The system according to claim 4, wherein the control circuit is arranged to generate pulses of the pulse-width modulated signal from fluctuations in a level of an output from the pressure sensor.

6. The system according to claim 2, where the system is arranged to adjust the degree of flow restriction so as to return said fluid pressure sensed by the control means to a target value in response to deviation of the sensed pressure from the target value.

7. The system according to claim 2, wherein the control means is arranged to control the variable flow restrictor at least partially in accordance with a difference between said fluid pressure sensed by the control means and a predefined target value.

8. The system according to claim 7, further comprising a pressure sensor arranged to sense the pressure in the fluid path and a control circuit arranged to receive an output from the pressure sensor and provide in response thereto a control signal to the variable flow restrictor;

wherein said control signal is a pulse-width modulated signal;

wherein the control circuit is arranged to generate pulses of the pulse-width modulated signal from fluctuations in a level of the output from the pressure sensor; and wherein the control circuit is arranged to generate a comparison value responsive both to the predefined target value and to changes in a moving average of the sensed pressure, and the control circuit is arranged to generate the pulse-width modulated signal using a result of comparing the output from the pressure sensor with the comparison value.

9. The system according to claim 1, wherein the variable flow restrictor is arranged to respond to variation in the fluid pressure at said location downstream of the portion within ½ second of the variation in the fluid pressure.

10. A module insertable into an ink jet printer, the module comprising a system according to claim 1, an inlet for connection to a fluid line from a gutter of an ink-jet printer, and an outlet for connection to a fluid line to a suction source of an ink jet printer.

11. The module according to claim 10, wherein said system comprises a pressure sensor arranged to sense the pressure in the fluid path and a control circuit arranged to receive an output from the pressure sensor and provide in response thereto a control signal to the variable flow restrictor, and wherein the module comprises fluid path means defining a first fluid path within the module from the inlet to the variable flow restrictor and a second fluid path within the module from the variable flow restrictor to the outlet, the pressure sensor being arranged to sense fluid pressure in the second fluid path, and the pressure sensor, the control circuit, the variable flow restrictor and the fluid path means being physically connected together.

12. A printer body for a continuous ink jet printer, the printer body being connectable to a printhead usable to form an ink jet using pressurized ink supplied to the printhead and to collect unused ink from the jet in a gutter and return the unused ink to the printer body, the printer body comprising:

an ink receiving part arranged to receive ink from the gutter of a printhead connected to the printer body;

a suction source;

a system according to claim 1, connected in a fluid path from said ink receiving part to the suction source; and an ink supply system arranged to supply pressurized ink to a printhead connected to the printer body.

13. A flexible connector for a continuous ink jet printer, the flexible connector being connectable at a first end thereof to a printhead usable to form an ink jet using pressurized ink supplied to the printhead and to collect unused ink from the jet in a gutter and return the unused ink to the flexible connector, and being connectable at a second end thereof to a printer body having a suction source arranged to receive ink returned from the gutter of the printhead and an ink supply system arranged to supply pressurized ink for transmission to the printhead, the flexible connector comprising:

a first fluid line connectable to receive pressurized ink from said printer body and convey the pressurized ink to said printhead;

a second fluid line connectable to receive suction from the suction source of said printer body, receive ink from the gutter of said printhead, and convey the ink from the printhead to the printer body under the influence of suction from the suction source; and a system according to claim 1, arranged to regulate the flow of fluid in said second fluid line.

14. The flexible connector according to claim 13, wherein said location is closer to the second end of the flexible connector than to the first end thereof.

15. A printhead for a continuous ink jet printer, the printhead being connectable to a printer body having an ink supply system arranged to supply pressurized ink and a suction source, the printhead comprising:

an ink jet source arranged to receive pressurized ink from a printer body connected to the printhead and form an ink jet therewith;

a gutter arranged to receive ink from the ink jet that is not used for printing;

a fluid line from the gutter arranged to supply ink from the gutter to the suction source of a printer body connected to the printhead; and a system according to claim 1 arranged to regulate the flow of fluid in said fluid line.

16. A continuous ink jet printer comprising:

a source of pressurized ink;

an ink jet source arranged to form an ink jet from pressurized ink supplied from said source of pressurized ink;

a gutter arranged to receive ink from the ink jet that is not used for printing;

a suction source operable to suck away ink that has been received by the gutter; and a system according to claim 1 arranged to regulate the flow of fluid in a fluid path from the gutter to the suction source.

17. The continuous ink jet printer according to claim 16, wherein said location is closer to the suction source than to the gutter.

18. A method of regulating the flow of fluid in a fluid path from a gutter of a continuous ink jet printer to a suction source, the method comprising adjusting a degree of flow restriction in a portion of the fluid path automatically, while an ink jet is running and fluid is being sucked along the fluid path, in response to a fluid pressure in the path at a location downstream of the portion.

19. The method according to claim 18, further comprising adjusting the degree of flow restriction so as to return the fluid pressure at the location to a target value in response to deviation of the fluid pressure from the target value.

20. The method according to claim 18, further comprising adjusting the degree of flow restriction in response to variation in the fluid pressure at the location downstream of the portion within ½ second of the variation in the fluid pressure.

21. The method according to claim 18, wherein the location is closer to the suction source than to the gutter.

22. A fluid flow regulation system for a fluid path from a gutter to a suction source of an ink jet printer, said fluid flow regulation system comprising a pressure sensor and a variable flow restrictor, wherein the variable flow restrictor is arranged to vary a degree of restriction of fluid flow through a portion of the fluid path in a direction from the gutter to the suction source in response to a level of pressure sensed by said pressure sensor, and wherein said pressure sensor is arranged to sense said level of pressure at a location in the fluid path downstream, with respect to said direction, from said portion.

23. A fluid flow regulation device, suitable for connection into a fluid path from an ink collection gutter to a suction source of an ink jet printer, said device comprising:

a fluid inlet connection, connectable to a line to receive fluid from said ink collection gutter;

a fluid outlet connection, connectable to another line to provide fluid to said suction source;

a variable flow restrictor;

a first fluid path from the fluid inlet to the variable flow restrictor;

a second fluid path from the variable flow restrictor to the fluid outlet; and a pressure sensor arranged to sense fluid pressure in the second flow path, wherein the variable flow restrictor is arranged to vary a degree of restriction of fluid flow from the first fluid path to the second fluid path in response to the fluid pressure sensed by the pressure sensor.

* * * * *